US005573816A

United States Patent [19]

Gaeta et al.

[11] Patent Number: 5,573,816

[45] Date of Patent: Nov. 12, 1996

[54] FRICTION COATING FOR FILM BACKINGS

[75] Inventors: Anthony C. Gaeta, Rockport; Gwo S. Swei, East Amherst, both of N.Y.

[73] Assignee: Norton Company, Worcester, Mass.

[21] Appl. No.: 467,499

[22] Filed: Jun. 6, 1995

[51] Int. Cl.[6] ..... B05D 3/06

[52] U.S. Cl. ..... 427/510; 427/386; 427/393.5; 427/521; 427/558

[58] Field of Search ..... 522/81, 86, 71; 524/451, 425, 493, 560; 427/386, 393.5, 558, 521, 510

[56] References Cited

U.S. PATENT DOCUMENTS

| | | | |
|---|---|---|---|
| 4,047,903 | 9/1977 | Hesse et al. | 428/413 |
| 4,196,243 | 4/1980 | Sachs et al. | 428/147 |
| 4,349,605 | 9/1982 | Biggs et al. | 522/81 |
| 4,608,287 | 8/1986 | Biotteau | 428/40 |
| 4,751,138 | 6/1988 | Tumey et al. | 428/413 |
| 4,833,834 | 5/1989 | Patterson et al. | 51/147 |
| 4,902,726 | 2/1990 | Hayashi et al. | 522/81 |
| 4,945,683 | 8/1990 | Phillips | 51/145 |
| 4,988,554 | 1/1991 | Peterson et al. | 428/148 |
| 5,306,739 | 4/1994 | Lucey | 522/81 |
| 5,356,956 | 10/1994 | Uemae et al. | 524/493 |
| 5,401,560 | 3/1995 | Williams | 428/148 |
| 5,451,446 | 9/1995 | Kincaid et al. | 428/148 |

*Primary Examiner*—Veronica P. Hoke
*Attorney, Agent, or Firm*—David Bennett

[57] ABSTRACT

A friction promoting layer is provided which comprises a binder and particulate material and is suitable for use with film backed coated abrasives. The binder used is one that shrinks upon drying and curing to ensure that particulates in the layer are not buried in the binder component.

6 Claims, 2 Drawing Sheets

FRICTION COATING FOR FILM BACKINGS

BACKGROUND TO THE INVENTION

The present invention relates to the production of coated abrasives and particularly to the production of coated abrasives carried on a film backing. Such products are typically used for fine finishing applications. In typical examples of such applications the abrasive is in the form of a sheet wound on a roll that is unwound from the roll and supplied to the grinding station where it is held against the workpiece to be ground using some sort of precession shaped tooling or shoes. After contact with the workpiece, the sheet is wound up on a take-up roll to ensure constant tension. A polymer film does not usually have very good friction qualities and if an untreated back surface were in contact with the shoes excessive slipping would occur and there would be wrapping of the film around the bearing suface and ultimately, breakage of the film. This results in extensive down-time for the manufacturer and is regarded as extremely undesirable.

The preferred film is often a polyester which has a unique blend of uniformity, non-compressibility, resistance to water and high tensile and tear strength. However it also has in high degree the problems of slippage referred to above which can lead to failure of proper indexing and even film breakage.

For this reason a film backing is usually supplied with a friction promoting surface. This surface is typically provided by abrasive particles in a binder. For reasons of speed of production, it is often preferred to use a radiation curable binder but these come with a practical problem. Radiation-curable binders are typically 100% reactive, that is there is no carrier medium which must be evaporated before the cure of the binder resin. Thus there is little shrinkage involved upon cure and the amount of the filler particles projecting above the binder layer is strictly dependant on the volume percent represented by the filler particles in the composition. The amount of abrasive that can be incorporated is limited by the rheology of the mixture as well as its viscosity which both impact the coatability of the binder/filler mixture. If too little is used however this can lead to the particles being buried in the binder with only relatively small amounts showing above the binder surface. This results in unsatisfactory frictional characteristics and can lead to slippage, film breakage, excessive tooling or shoe wear and tooling contamination.

In a preferred product the friction coating allows a pattern of rapid, slip/stick events to occur such that, overall, the pressure remains relatively constant. However all too often with conventional back coatings the frictional characteristics degrade with time. This occurs as the relatively few exposed grits are worn down and slipping increases. Slipping means relative movement of the backing with respect to the surfaces on which the back surface of the film bears and consequent wearing away of these surfaces.

A backing has now been devised that avoids the above problems and allows the pressure of the belt against the workpiece to be held reasonably constant with minimal slippage and therefore wear on the members against which the back surface bears during the finishing operation.

GENERAL DESCRIPTION OF THE INVENTION

One aspect of the present invention provides a friction promoting coating composition which comprises from about 10 to about 40% by volume of a radiation-curable binder, from about 30 to about 70% by volume of a particulate material and at least 20% by volume of a liquid carrier medium.

A further aspect of the present invention provides a process for producing a film backed coated abrasive which comprises coating the non-abrading surface with a friction promoting layer comprising a water based radiation curable binder and a particulate material, said layer shrinking by from about 20 to about 60% when the layer is dried and the binder is cured.

Yet another aspect provides a film backed coated abrasive strip, (including a belt), having a friction promoting layer on the surface opposite the abrasive bearing surface said layer comprising a radiation cured binder and a particulate material in volume proportions of from about 25 vol % to about 40 vol % of binder and from about 60 to about 75 vol % of the particulate material.

Because the coating composition comprises a carrier medium which is lost upon drying, the coating composition applied can carry much higher levels of particulate material than would be possible in the absence of the medium. In addition the loss of the medium causes the volume of the coating composition to shrink, thus exposing the particulate material above the level of the cured binder in the cured coated backing.

DETAILED DESCRIPTION OF THE INVENTION

The radiation curable binder is typically a water-based acrylate formulation such as a urethane acrylate, an epoxy-acrylate, a polyester or an epoxy-novolac. Preferred binders include urethane acrylates such a NeoRad 440 or 3709 which are available under those trade designations from Zeneca Resins. Other suitable radiation curable binders include resins from UCB Chemicals and/or Sartomer Resins which include urethane-(meth)acrylates, epoxy-(meth)acrylates, polyesters and (meth)acrylic (meth)acrylates. The binder is present in the formulation applied as a layer in the form of a dispersion or solution in a liquid medium. The medium is most commonly water but other readily volatilized liquids may be used including organic solvents such as hydrocarbons, alcohols, heterocyclics or ketones.

The preferred medium, or carrier liquid, is water and the amount of binder in the aqueous formulation is sufficient to ensure that, upon removal of the water the volume shrinkage of the binder phase is from about 20 to about 60% and preferably from about 40 to about 50%. In practice this means that the solids content of the binder dispersion is about 80 to about 40% and preferably from about 60 to 50% by volume.

The particulate material incorporated in the friction layer may be an abrasive such as alumina or silicon carbide but more often it is preferred to use a material that is less hard so as to minimize the amount of abrasion damage to the tooling surfaces. Thus particulate materials such as silica and talc are in general preferred. The particle sizes and morphology can be dictated by the end use for the product. Usually however the particle sizes that is most commonly used is from about 20 to about 150 microns.

To improve the interface adhesion between the particulate material and the binder, it is preferred to treat the particulate material with a coupling agent such as a silane. This has the effect of ensuring good dispersion of the particulates as well as excellent retention of the particulate within the binder layer when in use as a result of adhesion between the particulate material and the binder.

The proportions of binder and particulate material in the formulation and in the layer are preferably from about 1:6 to about 1:1 and more preferably from about 1:4 to about 1:1.5.

DETAILED DESCRIPTION OF DRAWINGS

DESCRIPTION OF PREFERRED EMBODIMENTS

The invention is now described in terms of certain products that embody one or more aspects of the invention. These are for the purpose of illustration and are not intended to imply any necessary limitation on the scope of the invention.

Figure 1:
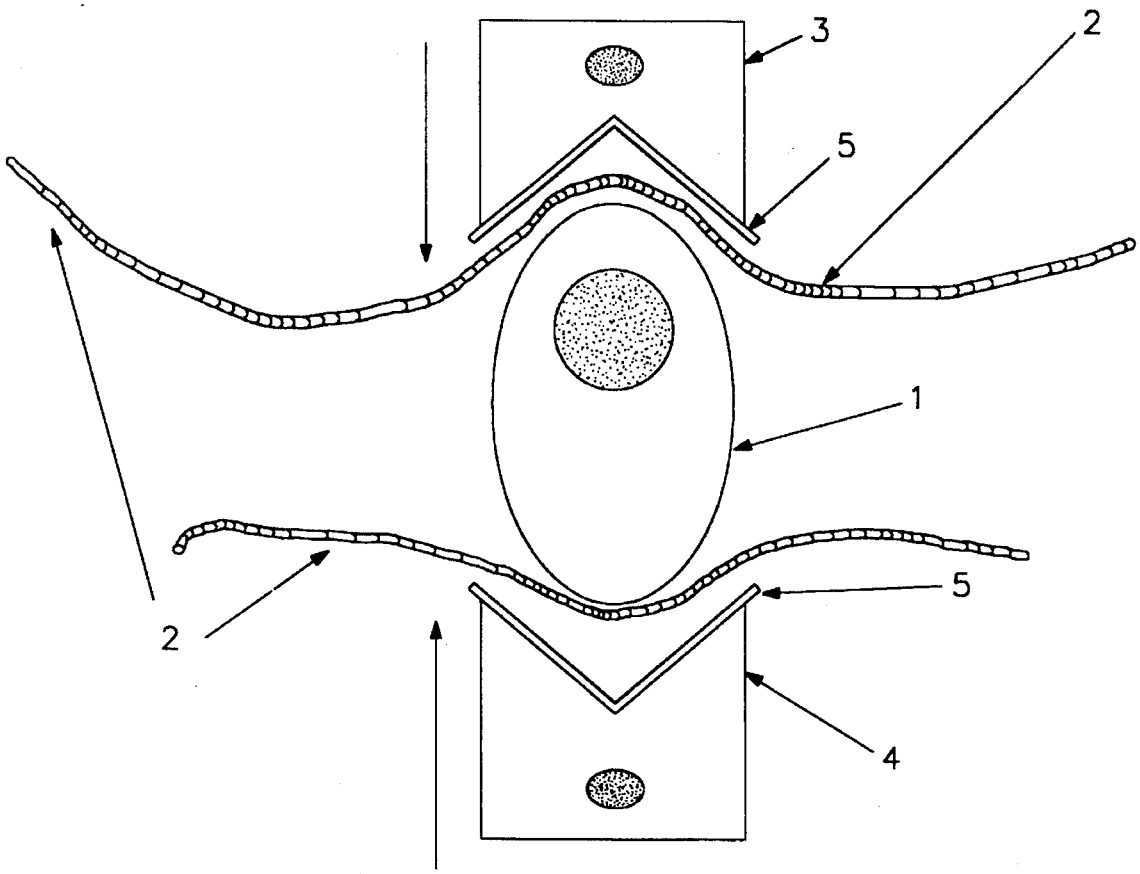
FIG. 1 is diagram of a set-up for camshaft grinding using two strips of film-backed coated abrasive.

A polyester film was provided with a number of different friction layers on the side opposite that used for abrading. The film was cut into strips used for camshaft grinding using the set-up illustrated in FIG. 1 wherein a camshaft, 1, to be microfinished is located between two abrasive strips, 2, which are urged in the direction of the arrows into contact with the camshaft portions to be ground by means of tools, 3 and 4, having diamond coatings on the surfaces, 5, contacting the film. The film has an abrasive bearing side, 6, and an opposed side, 7, on which a friction promoting surface is deposited.

The clamping force is usually about 70 lbs and the camshaft is rotated at 70 rpm. The film is oscillated at about 450 oscillations per minute. A water-based coolant was used during the microfinishing.

The friction promoting layers used comprised, as the filler, silica particles with different particle sizes and a binder that was a urethane acrylate available from Zeneca Resins under the trade name NeoRad 3709. The binder had a solids content of 37% by weight. The proportions of binder to particulate in the finished layer were as shown in the Table given below.

Drying of the friction promoting layer was performed in a conventional manner using an oven. The dried layer was then treated with UV light to cause cure of the urethane acrylate binder. The shrinkage of the layer upon drying to remove the water and after cure of the binder was about 40%.

The film strips according to the invention were then compared side by side with a conventionally backed film strip based on the same polyester film and abrasive coating layer but with a non-shrinking binder formulation in the friction promoting layer. The results are shown in the Table below.

TABLE

| PARTIC.:BOND SILICA | PERFORMANCE OF INVENTION PROD. | PERFORMANCE OF PRIOR ART PROD. |
|---|---|---|
| 1.85:1 A106 MINSIL 40 | NO STRIPPING OR SLIPPING | STRIPPING AND SLIPPING |
| 2.33:1 A107 MINSIL 40 | NO STRIPPING OR SLIPPING | STRIPPING AND SLIPPING |
| 3:1 A101 MINSIL 140F | NO STRIPPING OR SLIPPING | STRIPPING AND SLIPPING |

The product according to the invention and a film with a friction promoting backing layer according to the invention were then compared in a test to evaluate the behavior under a 50 pound load. The measured load on the film as it was pulled over the bearing surface was plotted against displacement from the rest position.

Figure 2A:
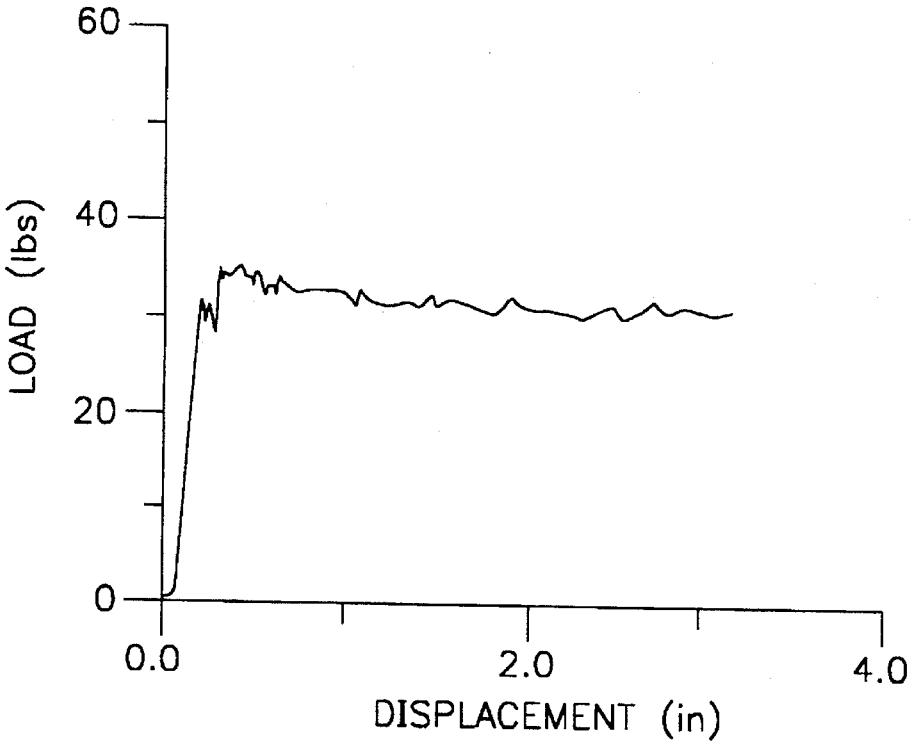
FIG. 2a PRIOR ART
FIG. 2 is a graph showing the performance of a product according to the invention and that of a prior art commercial product.
Figure 2B:
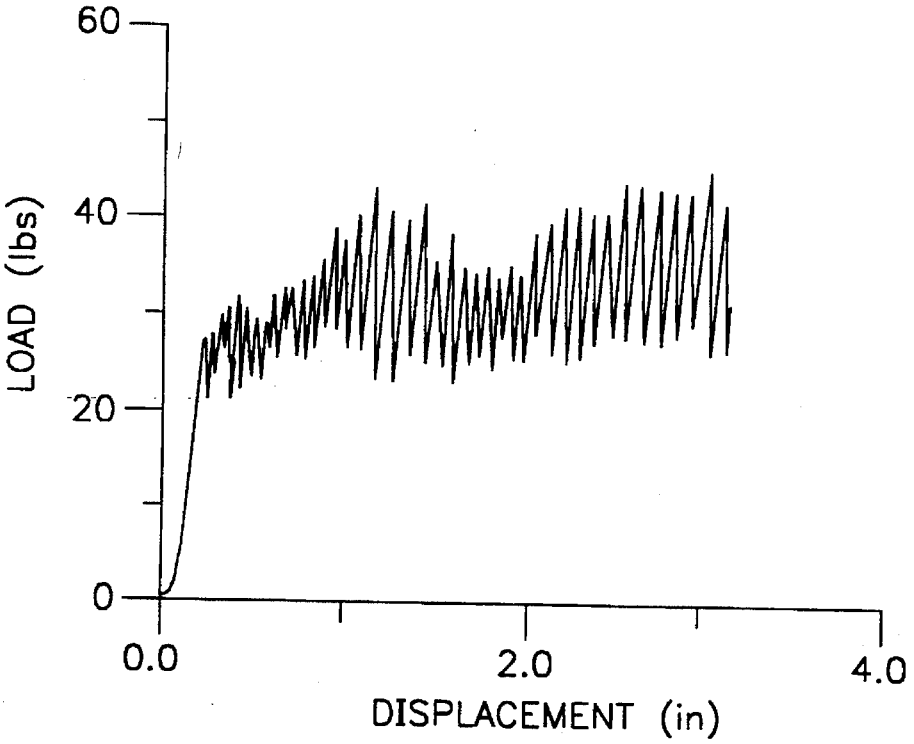

The results are shown in FIG. 2 in which the top graph shows the performance of a prior art product. As will be seen, after an initial steady load level the load begins to drop with occasional hitches indicating that slippage is occurring. By contrast the product according to the invention shows the characteristic stretch/release behavior with no indication that the load is decreasing indicating slippage.

What is claimed is:

1. A process for producing a film backed coated abrasive which comprises coating the non-abrading surface of the film backing with a friction promoting layer comprising a radiation-curable binder, a particulate material and at least 20% of a liquid carrier medium, drying and curing said friction-promoting layer whereby said layer is caused to shrink in volume by from about 20 to about 60%.

2. A process according to claim 1 in which the friction promoting layer comprises from about 10 to about 40% by volume of a radiation-curable binder, from about 30 to about 70% by volume of a particulate material and at least 20% by volume of a liquid carrier medium.

3. A process according to claim 1 in which the liquid carrier medium is water.

4. A process according to claim 1 in which the volume ratio of particulate to binder is from about 1:1 to about 4:1.

5. A process according to claim 1 in which the binder is selected from the group consisting of urethane-(meth)acrylates, epoxy-(meth)acrylates, epoxy-novolac (meth)acrylates, polyester and (meth)acrylic (meth)acrylates.

6. A process according to claim 1 in which the particulate material is first treated with a coupling agent and is selected from the group consisting of silica, talc and calcium carbonate.

* * * * *